US011376193B2

(12) United States Patent
Bekemeyer

(10) Patent No.: US 11,376,193 B2
(45) Date of Patent: Jul. 5, 2022

(54) SYRINGE HOLDER ASSEMBLY

(71) Applicant: Eric Bekemeyer, Washington, KS (US)

(72) Inventor: Eric Bekemeyer, Washington, KS (US)

(73) Assignee: Eric Bekemeyer, Washington, KS (US)

( * ) Notice: Subject to any disclaimer, the term of this patent is extended or adjusted under 35 U.S.C. 154(b) by 114 days.

(21) Appl. No.: 16/916,516

(22) Filed: Jun. 30, 2020

(65) Prior Publication Data

US 2021/0000691 A1 Jan. 7, 2021

Related U.S. Application Data

(60) Provisional application No. 62/869,108, filed on Jul. 1, 2019.

(51) Int. Cl.
*A61J 1/16* (2006.01)

(52) U.S. Cl.
CPC ..... *A61J 1/16* (2013.01); *A61J 2200/00* (2013.01)

(58) Field of Classification Search
CPC ..... A61J 1/16; A61J 2200/00; F16M 13/02; F16M 13/00; F16M 11/08; F16M 11/041
See application file for complete search history.

(56) References Cited

U.S. PATENT DOCUMENTS 4,063,704 A * 12/1977 Rother ..... A01K 97/10 248/515
4,225,106 A * 9/1980 Eplan ..... A45D 20/12 219/242
5,301,822 A 4/1994 Coleman et al.
6,496,094 B2 12/2002 May, III
8,505,420 B2 8/2013 Alfaro
8,967,562 B1 * 3/2015 Bileth ..... F16M 13/022 248/206.5
9,038,971 B1 * 5/2015 Guthrie ..... F16M 11/40 248/121
9,630,286 B1 4/2017 Pomerenke
9,683,589 B2 * 6/2017 Ports ..... G09F 3/204
2007/0034761 A1 * 2/2007 De Boer ..... B44D 3/14 248/309.1
2009/0314813 A1 * 12/2009 Woolery ..... A45F 5/021 224/183

OTHER PUBLICATIONS

Magnetic Container Holder; Amazon webpage https://www.amazon.com/Mechanics-Time-Savers-MTS100-Container/dp/B000TQ17DE.
Universal Flexible Magnetic Metal Base Holder Stand for Dial Test Indicator Tool; Ebay webpage https://www.ebay.com/p/12028297393.
Magnetic Strap for Hand Tools; webpage https://www.sgdusastore.com/image/popup?imagePath=%2fimages%2fproduct%2flarge%2f2548.jpg.

* cited by examiner

*Primary Examiner* — Anita M King
(74) *Attorney, Agent, or Firm* — Hovey Williams LLP

(57) ABSTRACT

A syringe holder assembly that safely and conveniently supports a syringe when it is not being used so as to keep the syringe clean and ready to use with little wasted motion. The syringe holder is configured for holding a syringe having a barrel and a handle and includes a syringe holder and a harness. The syringe holder includes a base configured to be mounted to a ferromagnetic structure; an arm pivotably connected to the base; and a holster connected to the arm. The harness is configured to be secured to the syringe and includes a main strap configured to encircle the barrel of the syringe to retain the harness on the syringe; and a magnet configured to magnetically attach the harness to the holster.

13 Claims, 4 Drawing Sheets

SYRINGE HOLDER ASSEMBLY

RELATED APPLICATION

This patent application claims priority benefit with regard to all common subject matter, of earlier-filed U.S. Provisional Patent Application Ser. No. 62/869,108, filed on Jul. 1, 2019, and entitled "SYRINGE HOLDER ASSEMBLY" and is hereby incorporated by reference in its entirety into the present application.

BACKGROUND

Cattle and other animals are often injected with vaccines, de-worming medicines, antibiotics, steroids, ointments, and other solutions. These solutions are typically injected with syringes supported in hand-held and hand-operated syringe guns (the syringes and guns are collectively referred to herein as "syringes"). Often, syringes are used to inject solutions in multiple animals as the animals walk through a chute, pen, or other confided space, so they are ideally placed nearby for quick and easy access. Some users carry the syringes in a belt or article of clothing, but this is dangerous. Others simply place the syringes on a nearby shelf, fencepost or even on the ground, but this risks contamination and damage and requires the user to retrieve the syringe each time it is used to inject an animal.

SUMMARY

Embodiments of the present invention solve the above-described problems and other problems by providing a syringe holder assembly that safely and conveniently supports a syringe when it is not being used so as to keep the syringe clean and ready to use with little wasted motion.

An embodiment of the syringe holder is configured for holding a syringe having a barrel and a handle and broadly comprises a syringe holder and a harness. The syringe holder comprises a base configured to be mounted to a ferromagnetic structure; an arm pivotably connected to the base; and a holster connected to the arm. The harness is configured to be secured to the syringe and comprises a main strap configured to encircle the barrel of the syringe to retain the harness on the syringe; and a magnet configured to magnetically attach the harness to the holster. In some embodiments, the magnet may be attached directly to the syringe.

BRIEF DESCRIPTION OF THE DRAWING FIGURES

Embodiments of the present invention are described in detail below with reference to the attached drawing figures, wherein.

Figure 1:
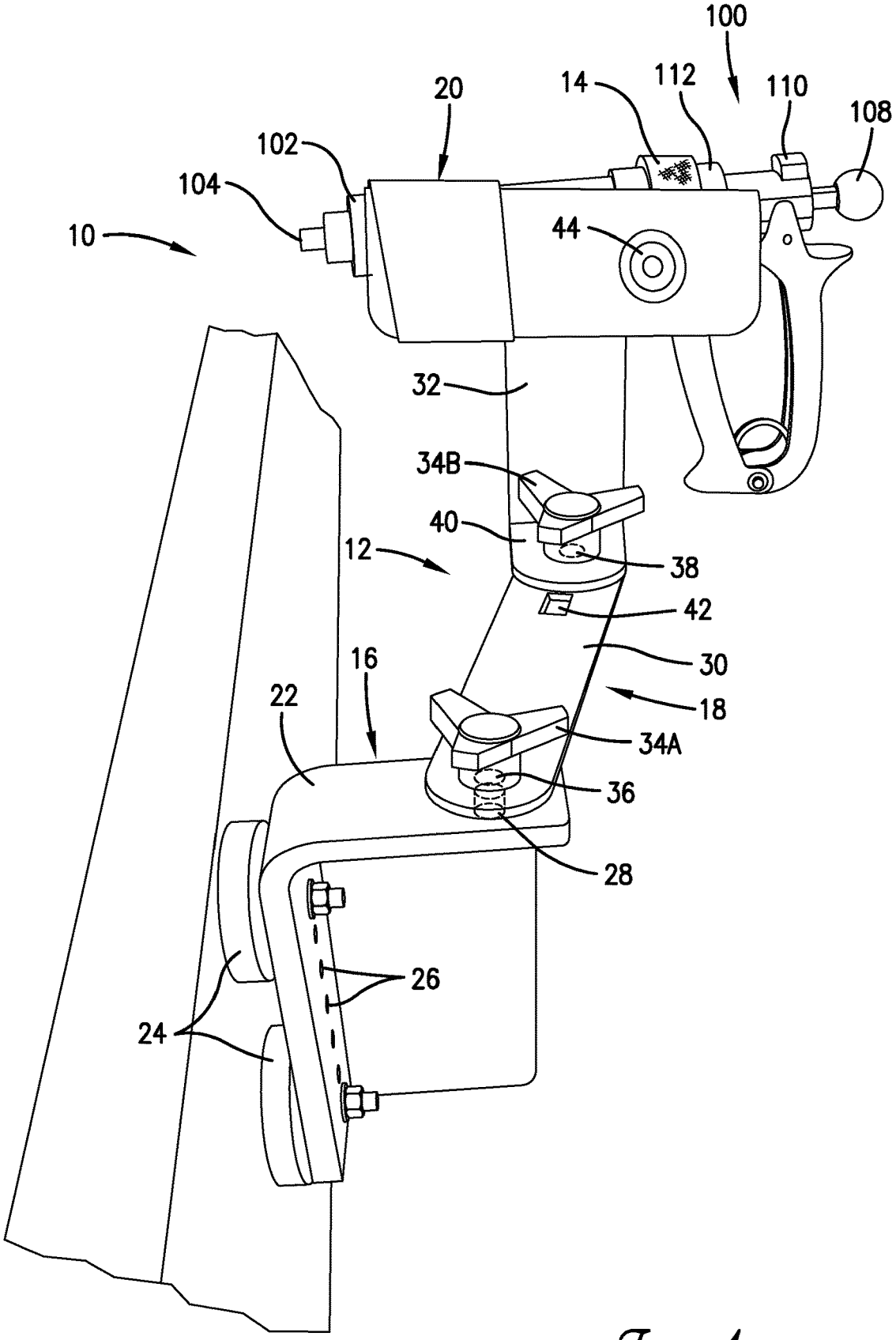
FIG. 1 is a perspective view of a side of the syringe holder assembly shown attached to a metal rail of a chute, pen, or other structure.
Figure 2:
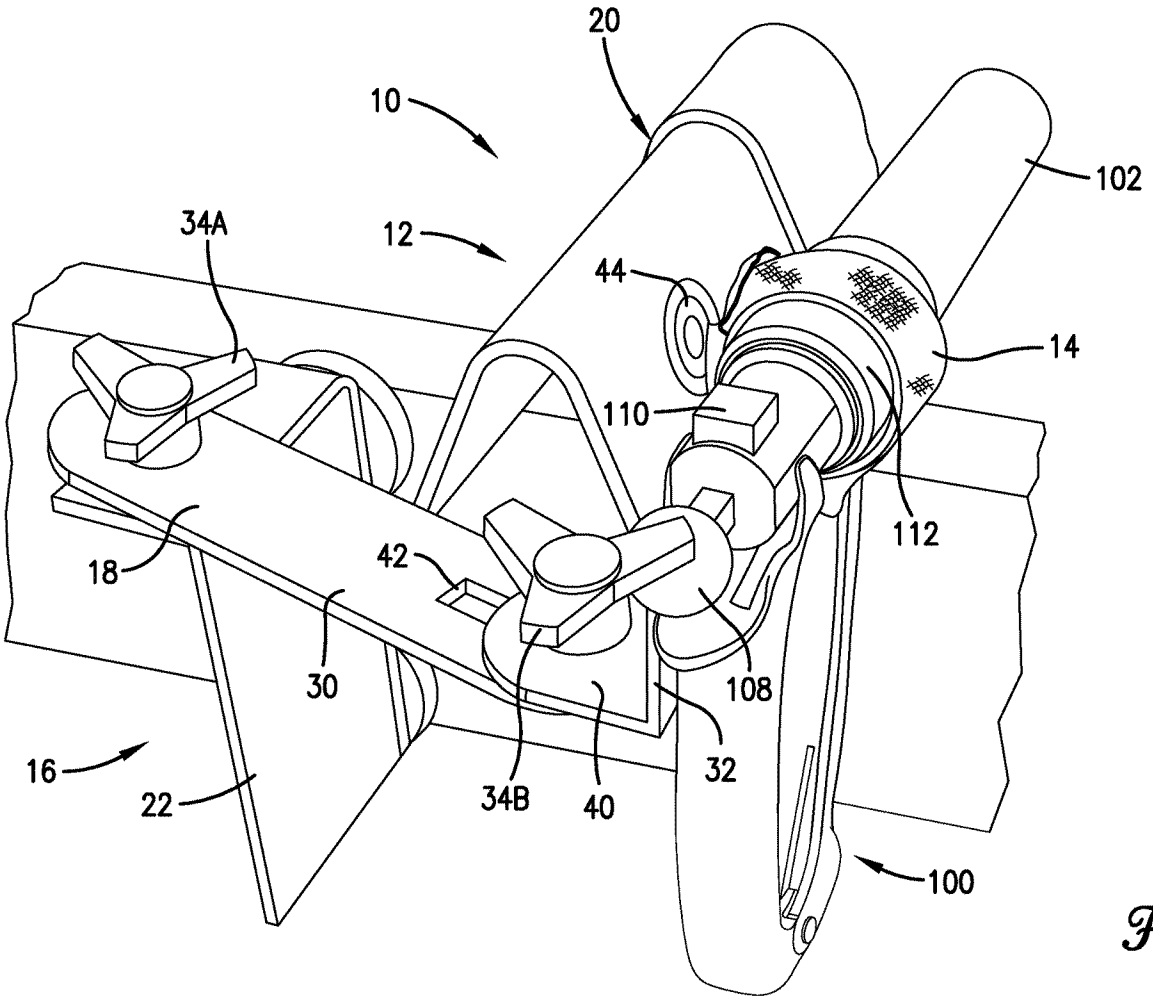
FIG. 2 is a perspective view of a rear of the syringe holder assembly.
Figure 3:
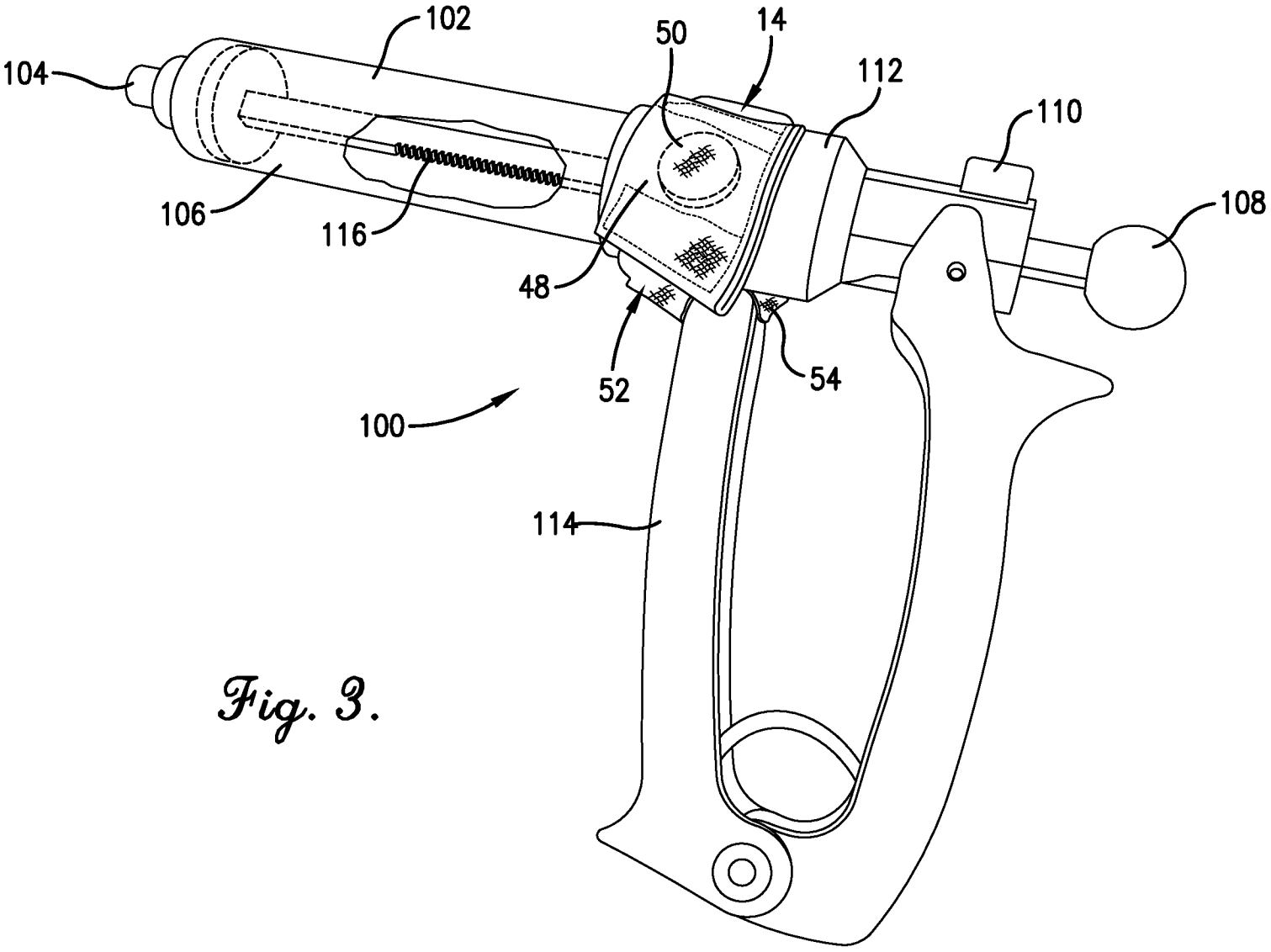
FIG. 3 is a perspective view showing the harness of the syringe holder assembly attached to a syringe.
Figure 4:
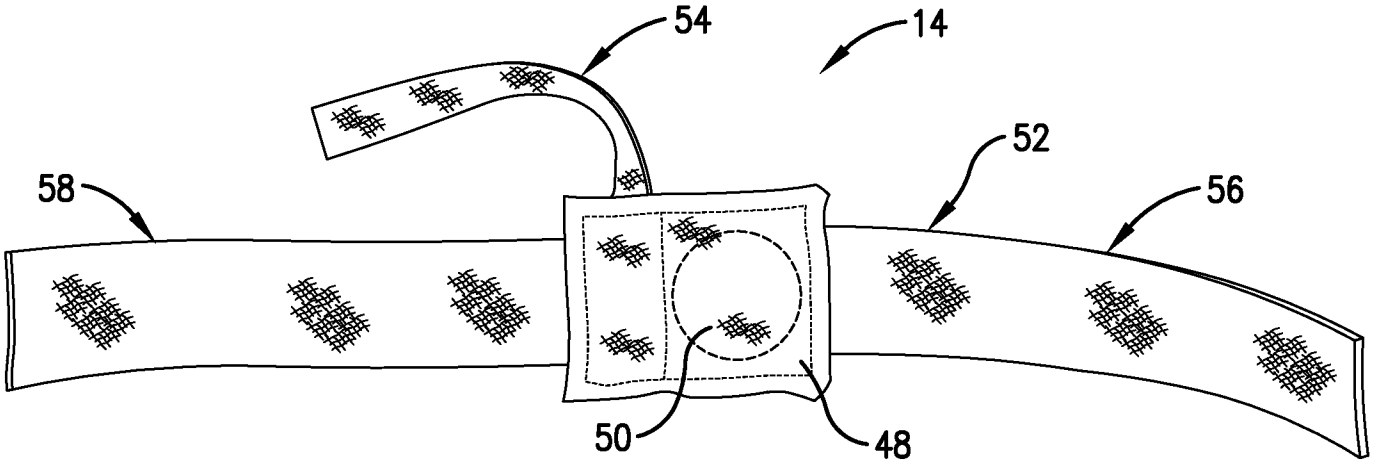
FIG. 4 is a perspective view showing the harness of the syringe holder assembly removed from the syringe.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

With reference to the drawing figures, a syringe holder assembly 10 constructed in accordance with an embodiment of the invention is illustrated. The syringe holder assembly 10 broadly comprises a syringe holder 12 and a harness 14. The syringe holder assembly 10 may be used for retaining a syringe 100 between medication applications.

The syringe 100 may be a gun-style hand tool for delivering fluid medication (vaccines, steroids, de-wormers, ointments, antibiotics, and the like) to an animal such as livestock, a large pet, a captive animal, or a wild animal. The syringe 100 may include a barrel 102, a nozzle 104, a piston 106, a knob 108, a ratcheting mechanism (not shown), a ratchet release 110, a dosage selector 112, and a handle 114.

The barrel 102 extends forward from the handle 114 and may be a hollow cylindrical tube for holding the medication. The barrel 102 may include visual markings for indicating an amount of medication therein.

The nozzle 104 is positioned near a front of the barrel 102 for dispensing medication. The nozzle 104 may also receive a needle for injecting medication into the animal.

The piston 106 is positioned in the barrel 102 for displacing the medication from the barrel 102. The piston includes ratchet teeth 116 for engaging and being advanced by the ratchet mechanism.

The knob 106 is attached to an aft end of the piston 104 for allowing the user to draw the piston 106 aftward and fill the barrel 102 with medication. The knob 106 may be a T-handle, a round ball, or the like.

The ratchet release 110 is a button or lever that disengages the ratchet mechanism from the ratchet teeth 116 of the piston 104. This allows the piston to be pulled aftward to draw medication into the barrel 102.

The dosage selector 112 is a dial that allows the user to select how much medication is dispensed via one activation of the handle 114. The dosage selector 112 may include visual markings for indicating the selected dosage.

The handle 114 is attached to the barrel 102 and may include a trigger or squeezable sections for advancing the piston a forward in the barrel 102 and displacing a dosage of medication. The handle 114 may have a spring or other biasing mechanism so the handle 114 automatically resets after the piston is advanced. The handle 114 may also engage the piston 104 via a ratcheting mechanism so the piston does not retract after being advanced by the handle 114.

The syringe holder 12 retains the syringe 100 when not in use and broadly includes a base 16, an arm 18, and a holster 20. The syringe holder 12 may support the syringe 100 at one of a plurality of positions, angles, and orientations and may be mounted to any ferromagnetic structure such as a corral panel, a gate, a fence, a barn or barn door, a cage, a vehicle, a tractor, a trailer, or any other suitable structure.

The base 16 supports the weight of the arm 18, the holster 20, and the syringe 100 and includes a frame 22 and a number of magnets 24. The base 16 may be a single structure with the magnets 24 embedded in the frame 22 or may be assembled via conventional tools as described below.

The frame 22 is configured to be mounted onto a ferromagnetic structure via the magnets 24 and includes magnet mounting holes 26 and a pivot hole 28. The frame 22 may also have features for attaching the base 16 to non-ferromagnetic structures via bolts, nails, rope, twine, cable, and the like.

The magnets 24 secure the frame 22 to a ferromagnetic structure and are attached to the frame 22 via studs inserted into the magnet mounting holes 26. Alternatively, the magnets 24 may be embedded in the frame 22. The magnets 24 may be adjustable for optimizing their attraction to the ferromagnetic structure.

The magnet mounting holes 26 extend horizontally through a vertical portion of the frame 22 for receiving the studs of the magnets 24 therethrough. The magnet mounting holes 26 may be slots for adjusting the magnets 24. In one embodiment the magnet mounting holes 26 are in vertical alignment with each other.

The pivot hole 28 extends vertically through a horizontal portion of the frame 22 for receiving an adjuster of the arm 18 therethrough. The pivot hole 28 may be a slot for sliding the arm 18 relative to the base 16.

The arm 18 is pivotably connected to the base 16 and includes a first arm section 30, a second arm section 32, and a number of adjusters 34A, B. The arm 18 allows the holster 20 to be set at one of several positions, angles, and orientations.

The first arm section 30 is a horizontally extending member including a first pivot hole 36 and a second pivot hole 38. The first arm section 30 may be a bar, a tube, a rod, or the like.

The first pivot hole 36 is positioned at a first end of the first arm section 30 and is aligned with the pivot hole 28 of the frame 22 for receiving the first adjuster 34A therethrough. Thus, the first arm section 30 is pivotably connected to the frame 22 via the first pivot hole 36. The first pivot hole 36 may be a slot for sliding the first arm section 30 relative to the frame 22.

The second pivot hole 38 is positioned at a second end of the first arm section 30 and is aligned with a pivot hole of the second arm section 32. The second pivot hole 38 may be a slot for sliding the second arm section 32 relative to the first arm section 30.

The second arm section 32 is a vertically extending member pivotably connected to the first arm section 30 and includes a lower horizontally extending tab 40. The second arm section 32 may be a bar, a tube, a rod, or the like.

The lower horizontally extending tab 40 abuts the first arm section 30 and includes a pivot hole 42. The lower horizontally extending tab 40 allows the second arm section 32 to essentially rotate about its longitudinal axis (or an offset axis) for realigning the holster 20.

The pivot hole 42 aligns with the second pivot hole 38 for receiving the second adjuster 34B therethrough. The pivot hole 42 may be a slot for sliding the second arm section 32 relative to the first arm section 30.

The adjusters 34A, B pivotably connect the frame 22, the first arm section 30, and the second arm section 32 together. Specifically, the first adjuster 34A pivotably connects the first arm section 30 to the frame 22 to create a "shoulder joint" and the second adjuster 34B pivotably connects the second arm section 32 to the first arm section 30 to create a rotating "elbow" joint. The adjusters 34A, B may be knobs, pins, bolts, clamps, or the like.

The holster 20 supports the syringe 100 and may be saddle, a sheath, a plate, a bar, or any other suitable shape. In one embodiment, the holster 20 is a bar having an inverted V shape. The holster 20 may be ferromagnetic or may have magnets 44 attached thereto. In one embodiment, the holster 20 includes left and right magnet targets and a cover.

The magnet targets 44A,B are positioned on opposite sides of the holster 20 and are visual markings that guide the user to align a magnet of the harness 14 to an ideal location on one side of the holster 20 depending on the orientation of the harness 14, as described below.

The cover 46 envelops portions of the holster 20 and may be a soft material for protecting the syringe 100. The cover 46 may be fabric, rubber, plastic, or the like.

The harness 14 wraps around the syringe 100 and includes a magnet casing 48, a magnet 50, a main strap 52, and a handle strap 54. The harness 14 secures the magnet 50 to the syringe 100.

The magnet casing 48 holds the magnet 50 and may be a fabric pouch, a sleeve, a housing, or the like. For example, the magnet casing 48 may be two pieces of fabric sewn together enclosing the magnet 50.

The magnet 50 is positioned in the magnet casing 48 for retaining the syringe 100 on the holster 20. The magnet 50 may be circular, rectangular, or any other suitable shape.

The main strap 52 encircles the barrel 102 for retaining the harness 14 on the syringe 100 and includes first and second sections 56, 58. Each section 56, 58 may include complementary securing means such as Velcro®, a pin and belt holes, clips, buckles, magnets, or the like. The main strap 52 may be adjustable for being secured to syringes of different shapes, sizes, and types.

The handle strap 54 encircles the handle 114 for retaining the harness 14 on the barrel 102 near the handle 114. The handle strap 54 may be a smaller strap that secures to the main strap 52 or to the magnet casing 48 via similar securing means as the main strap 52. The handle strap 54 may be adjustable for being secured to syringes of different shapes, sizes, and types.

In another embodiment, one or more magnets may be attached directly to the syringe so the syringe may be supported in the holster without the harness.

Use of the syringe holder assembly 10 will now be described. First, the harness 14 may be attached to the syringe 100. Specifically, the main strap sections 56, 58 of the main strap 52 may be wrapped around the barrel 102 of the syringe 100 near the handle 114 and connected to each other with the casing 48 and hence the magnet 50 positioned to a left or right side of the barrel 102. The handle strap 54 may then be wrapped around the handle 114 and secured to the main strap 52, the casing 48 or itself.

The base 16 of the syringe holder 12 may be mounted to a structure near which animal doctoring will be performed. For example, the base 16 may be mounted to a corral panel or gate via magnets 24. The magnets 24 may need to be repositioned depending on the structure's geometry or features. If the structure is not ferromagnetic, the base 16 may be mounted to the structure via bolts, screws, cables, twine, ropes, or the like.

The arm 18 may then be adjusted so the holster 20 is in an easily reachable position and convenient orientation. To that end, the first and second arm sections 30, 32 may be pivoted relative to each other and relative to the base 16 via the adjusters 34. The adjusters 34 may then be tightened once the holster 20 is in the desired position and orientation.

The syringe 100 may then be positioned on the holster 20 via the magnet 50. Specifically, the magnet 50 should be aligned with one of the magnet targets 44A, B. The syringe 100 may be retrieved from the holster 20 for applying medication to an animal by pulling the syringe 100 away from the holster 20. After use, the syringe may be quickly and easily placed back in the holster so it can stay clean and be quickly accessed again for subsequent use.

The above-described syringe holder assembly 10 provides several advantages. For example, the syringe holder 12 can be mounted to virtually any structure, and particularly any ferromagnetic structure such as a corral panel or gate. The holster 20 can be set in virtually any position, angle, and orientation via the arm 18 and adjusters 34A, B. The holster 20 is two-sided, thus allowing the syringe 100 to be positioned on either side for right-handed and left-handed users. The holster 20 is ferromagnetic, thus allowing syringes with built-in magnets to be attached thereto. The harness 14 is fully adjustable and provides magnetic adaption for syringes that do not have magnets, thus making the syringe holder assembly 10 compatible with virtually any syringe.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A syringe holder assembly for holding a syringe having a barrel and a handle, the syringe holder assembly comprising:

a syringe holder comprising:
- a base configured to be mounted to a support structure;
- an arm pivotably connected to the base; and
- a holster connected to the arm; and a harness configured to be secured to the syringe, the harness comprising:
- a main strap configured to encircle the barrel of the syringe to retain the harness on the syringe; and
- a magnet configured to magnetically attach the harness to the holster.

2. The syringe holder assembly as set forth in claim 1, the base comprising a support frame having a plurality of magnet holes and a pivot hole; and a plurality of magnets configured to mount the base to the support structure, the magnets being attached to the support frame via the magnet holes.

3. The syringe holder assembly as set forth in claim 1, the arm comprising a horizontally extending first section pivotably connected to the base; a vertically extending second section pivotably connected to the first section; a first adjuster connecting the first section to the base; and a second adjuster connecting the second section to the first section.

4. The syringe holder assembly as set forth in claim 3, wherein the holster is connected to the second section, the holster being configured to magnetically receive the syringe, the first and second adjusters being configured to retain the holster in one of a plurality of positions, angles, and orientations.

5. The syringe holder assembly as set forth in claim 1, the harness further comparing a magnet casing, with the magnet positioned in the magnet casing; and a handle strap configured to encircle a portion of the handle to retain the harness near the handle.

6. The syringe holder assembly as set forth in claim 1, the harness comprising a second magnet configured to magnetically attach the harness to the holster.

7. A syringe holder assembly for holding a syringe having a barrel and a handle, the syringe holder assembly comprising:

a syringe holder comprising:

a base configured to be mounted to a support structure, the base comprising a support frame having a plurality of magnet holes and a pivot hole; and a plurality of magnets configured to mount the base to the support structure, the magnets being attached to the support frame via the magnet holes;

an arm pivotably connected to the base; and a holster connected to the arm; and a magnet configured to magnetically attach the syringe to the holster.

8. A syringe holder assembly for holding a syringe having a barrel and a handle, the syringe holder assembly comprising:

a syringe holder comprising:

a base configured to be mounted to a support structure; an arm pivotably connected to the base; and a holster connected to the arm; and a magnet configured to magnetically attach the syringe to the holster, the arm comprising a horizontally extending first section pivotably connected to the base; a vertically extending second section pivotably connected to the first section; a first adjuster connecting the first section to the base; and a second adjuster connecting the second section to the first section.

9. The syringe holder assembly as set forth in claim 8, wherein the holster is connected to the second section, the holster being configured to magnetically receive the syringe, the first and second adjusters being configured to retain the holster in one of a plurality of positions, angles, and orientations.

10. A syringe holder assembly for holding a syringe having a barrel and a handle, the syringe holder assembly comprising:

a syringe holder comprising:

a base configured to be mounted to a support structure; an arm pivotably connected to the base; and a holster connected to the arm; and a magnet configured to magnetically attach the syringe to the holster, further comprising a harness configured to be secured to the syringe.

11. The syringe holder assembly as set forth in claim 10, the harness comprising a main strap configured to encircle the barrel of the syringe to retain the harness on the syringe; a magnet casing, with the magnet positioned in the magnet casing; and a handle strap configured to encircle a portion of the handle to retain the harness near the handle.

12. A syringe holder assembly for holding a syringe having a barrel and a handle, the syringe holder assembly comprising:

a syringe holder comprising:

a base including:

a support frame having a plurality of magnet holes and a pivot hole; and a plurality of magnets configured to mount the base to a ferromagnetic structure, the magnets being attached to the support frame via the magnet holes;

an arm including:

a horizontally extending first section pivotably connected to the base; and a vertically extending second section pivotably connected to the first section;

a first adjuster connecting the first section to the base; and a second adjuster connecting the second section to the first section; and a holster connected to the second section, the holster being configured to magnetically receive the syringe, the first and second adjusters being configured to retain the holster in one of a plurality of positions, angles, and orientations; and a harness configured to be secured to the syringe, the harness including:

a magnet casing;

a magnet positioned in the magnet casing;

a main strap configured to encircle the barrel of the syringe to retain the harness on the syringe; and a handle strap configured to encircle a portion of the handle to retain the harness near the handle, the magnet being configured to magnetically attach the harness to the holster.

13. The syringe holder assembly as set forth in claim 12, the harness comprising a second magnet configured to magnetically attach the harness to the holster.

* * * * *